US006927730B2

(12) United States Patent
Tang et al.

(10) Patent No.: US 6,927,730 B2
(45) Date of Patent: Aug. 9, 2005

(54) RADIATION DEVICE WITH A L-SHAPED GROUND PLANE

(75) Inventors: Chia-Lun Tang, Hsinchu (TW); Shyh-Tirng Fang, Hsinchu (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 29 days.

(21) Appl. No.: 10/647,256

(22) Filed: Aug. 26, 2003

(65) Prior Publication Data

US 2004/0212535 A1 Oct. 28, 2004

(30) Foreign Application Priority Data

Apr. 25, 2003 (TW) ..... 92109812 A

(51) Int. Cl.[7] ..... H01Q 1/38
(52) U.S. Cl. ..... 343/700 MS; 343/702; 343/847
(58) Field of Search ..... 343/700 MS, 702, 343/845, 847

(56) References Cited

U.S. PATENT DOCUMENTS 4,791,423 A * 12/1988 Yokoyama et al. .. 343/700 MS
6,366,243 B1 * 4/2002 Isohatala et al. ..... 343/700 MS
6,483,463 B2 * 11/2002 Kadambi et al. .... 343/700 MS
6,606,061 B2 * 8/2003 Wong et al. ..... 343/700 MS

* cited by examiner

*Primary Examiner*—Shih-Chao Chen
(74) *Attorney, Agent, or Firm*—Bacon & Thomas, PLLC

(57) ABSTRACT

A radiation device having a L-shaped ground plane. The radiation device comprises a radiation patch; a feeding-in device for exciting the radiation patch; and a L-shaped ground plane. The L-shaped ground plane has a first ground plane and a second ground plane, and the first ground plane is parallel to the radiation patch and an included angle is formed between the fist and the second ground plane. The feeding-in device is used for coupling the energy to the radiation patch, and is connected to the first ground plane of the L-shaped ground plane.

10 Claims, 7 Drawing Sheets

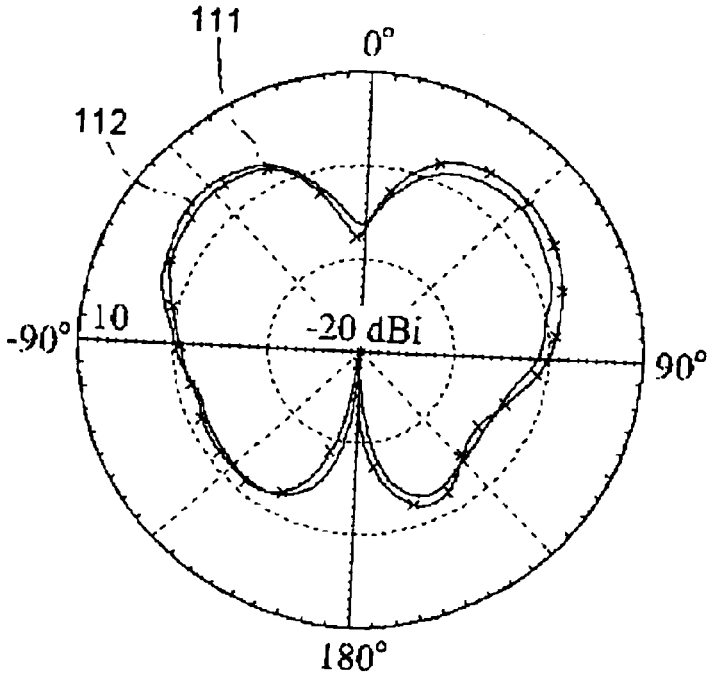
FIG.11
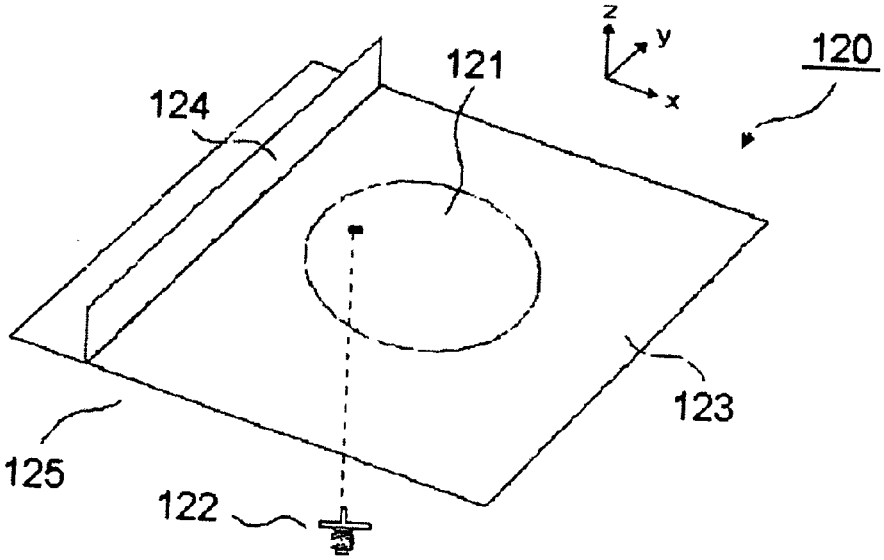
FIG..12

RADIATION DEVICE WITH A L-SHAPED GROUND PLANE

BACKGROUND OF THE INVENTION

1. Field of the Invention

The present invention relates to a radiation device, and particularly to a radiation device with a L-shaped ground plane.

2. Description of the Prior Art

In recent years, the communication industry has advanced vigorously and various communication products have been very successfully developed and manufactured. During this time, much attention has been paid to the design of the antenna of the related communication product. In the various antenna structures, the patch antenna is popular in the market for its characteristics of low profile and lower back radiation. However, the characteristic of the radiation pattern of the prior art patch antenna usually causes a maximum field is generated above the radiation patch in the direction perpendicular to the antenna (that is, $\theta=0°$ or having a broadside radiation pattern). And when the angle of $|\theta|$ increases, the radiation intensity of electric field will apparently increase. This kind of radiation characteristic for the antenna is unsuitable to the design of the radiation pattern needing omni-directional field above the radiation patch antenna. Although the variation of the filed of the antenna radiation pattern will slow down if the size of the ground plane is reduced, it will cost the gain of the antenna. Thus, the application of the prior art patch antenna is limited for the wireless communication product requiring an antenna with wider receiving/transmitting angle.

Please refer to FIG. 1. FIG. 1 is a perspective diagram of a prior art shorted microstrip antenna 10 with multiple ground planes. The antenna 10 comprises a radiation patch 11, a compound ground plane 11*a,* and a feeding-in device 15 for connecting the radiation patch 11 to the multiple ground planes 11*a*. The multiple ground plane 11*a* comprises a first grounding conductive sheet 12 parallel to the radiation patch 11, a second grounding conductive sheet 13 connected to the radiation patch 11 and the first grounding conductive sheet 12, and a third grounding conductive sheet 14. The third grounding conductive sheet 14 is perpendicular to the first grounding conductive sheet 12, and parallel to the second grounding conductive sheet 13.

The antenna 10 is so designed that the multiple ground planes 11*a* are employed for improving the beam-tilt characteristic caused by the shorted structure so as to promote the antenna gain in the z direction. Although the designed structure of the antenna 10 can improve the distribution of the radiation pattern, the multiple ground planes 11*a* have to be composed of three grounding conductive sheets 12, 13, 14 and the complexity of the structure design is increased. Besides, the second grounding conductive sheet 13 must be higher than the radiation patch 11, and the is will affect the appearance of the product and increase the cost.

Please refer FIG. 2. FIG. 2 is a perspective diagram of a coaxial line feed-in broadband patch antenna 20 having a U-shaped ground plane 22. The antenna 20 comprises an E-shaped radiation patch 21, a U-shaped ground plane 22, a coaxial feed-in line 23 for connecting the E-shaped radiation patch 21 and the U-shaped ground plane 22.

The antenna 20 is so designed that cross polarization of the radiation pattern is reduced so as to increase the purity of the linear polarization of the antenna. However, this designed structure will not apparently improve the gain of the antenna. In addition, as shown in FIG. 2, the U-shaped ground plane 22 has to have a planar ground plane 22*a* and two perpendicular ground planes 22*b*. In other words, the plane 22 is composed of three metal pieces so as to increase the complexity of the structure of the antenna 20.

SUMMARY OF THE INVENTION

Therefore, the main objective of the present invention is to provide a radiation device with a L-shaped ground plane. The radiation device has a simpler structure, enhanced broadside radiation patterns and the antenna profile is remained to be low. In the proposed antenna design, the radiation intensity of the antenna in the direction of $|\theta|\leqq 90°$ can be promoted, and the inventive radiation device is suitable to all kind of planar patch antenna structures, such as shorted patch antennas, dual-frequency planar patch antennas and so on.

The present invention relates to a radiation device wth a L-shaped ground plane. The radiation device comprises a radiation patch; a feeding-in device for exciting the radiation patch; and a L-shaped ground plane. The L-shaped ground plane has a first ground plane and a second ground plane. The first ground plane is approximately parallel to the radiation patch, and an included angle will be formed between the first and second ground plane. The feeding-in device will couple the energy to the radiation patch, and is connected to the first ground plane of the L-shaped ground plane.

BRIEF DESCRIPTION OF THE DRAWINGS

The accompanying drawings, which are incorporated in and form part of the specification in which like numerals designate like parts, illustrate preferred embodiments of the present invention and together with the description, serve to explain the principles of the invention. In the drawings:

FIG. 3(*b*) is a side view of the radiation device 30 according to the first embodiment;

FIG. 4(*b*) is a perspective diagram of the radiation exciting current of the radiation device on the radiation patch according to the first embodiment;

FIG. 11 shows the measured result of the antenna radiation pattern of the radiation device on the x-z plane when the radiation device is operated in a high frequency according to the fourth embodiment; and FIG. 12 is a perspective diagram of a radiation device according to a fifth embodiment of the present invention.

DETAILED DESCRIPTION OF THE PREFERRED EMBODIMENT

Figure 1:
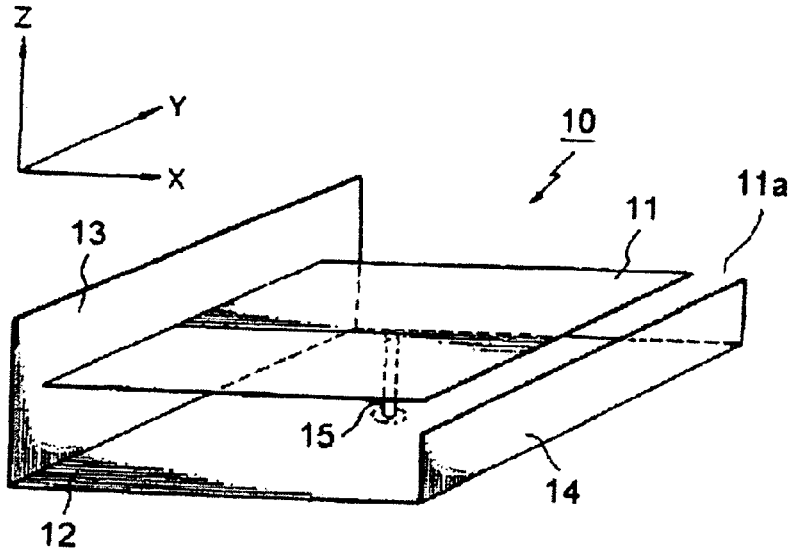
FIG.1(PRIOR ART)
FIG. 1 is a perspective diagram of a prior art shorted microstrip antenna with multiple ground planes.
Figure 2:
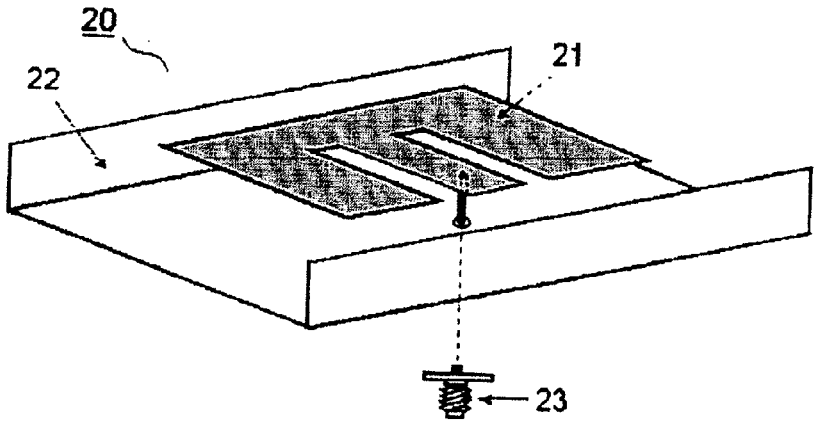
FIG.2(PRIOR ART)
FIG. 2 is a perspective diagram of a coaxial line feed-in broadband patch antenna 20 with a U-shaped ground plane.
Figure 3A:
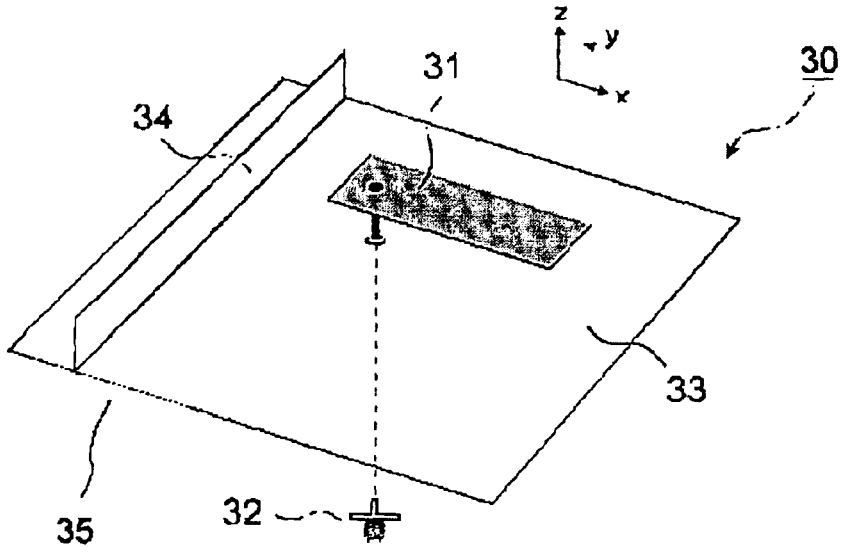
FIG. 3(*a*) is a perspective diagram of a radiation device 30 with a L-shaped ground plane 35 according to a first embodiment of the present invention.
Figure 3B:
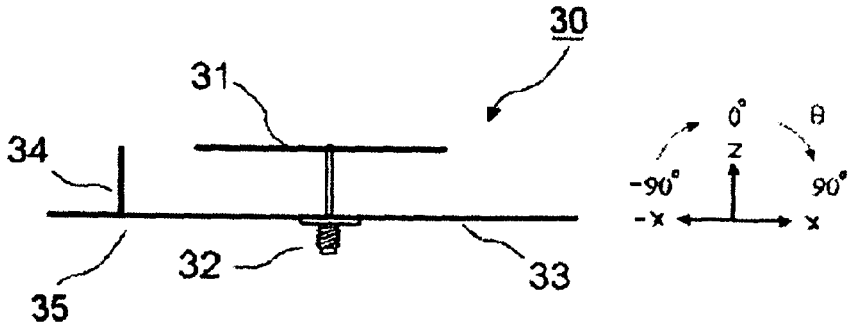

Please refer to FIGS. 3(*a*) and 3(*b*). FIG. 3(*a*) is a perspective diagram of a radiation device 30 with a L-shaped ground plane 35 according to a first embodiment of the present invention. FIG. 3(*b*) is a side view of the radiation device 30. The radiation device 30 comprises a radiation patch 31, a feeding-in device 32, and a L-shaped ground plane 35. The radiation device 30 transmits the energy through the feeding-in device 32, and excites the radiation patch 31 to generate radiation. The L-shaped ground plane 35 si composed of a first ground plane 33 and a second ground plane 34. The first ground plane 34 is almost perpendicular to the first ground plane 33. The radiation metal piece (radiation patch) 31 is fixed on the first ground plane 33 by using a non-conductive post (not shown), and the feeding-in device 32 is used for connecting the radiation patch 31 and the L-shaped ground plane 35, and for exciting the radiation patch 31 to transmit signals. On the left side of the first ground plane 33 (namely, the x direction), the second ground plane 34, which is spaced-from and not in contact with the radiation patch 31, is extended upward from the surface of the first ground plane 33 where the radiation patch 31 is installed so as to form a ground plane structure to form a L-shaped ground plane 35.

As described above, the L-shaped ground plane 35 is composed of two ground metal sheets, namely the first ground plane 33 and the second ground plane 34. The first ground plane 33 is roughly parallel to the radiation patch 31, and the second ground plane 34 is connected to the first ground plane 33 in the direction of the exciting current of the radiation patch 31, and they are not coplanar. Furthermore, the height of the second ground plane 34 is less than the twice distance between the radiation patch 31 and the first ground plane 33.

Based on the above designed structure, the strength of the antenna radiation electric field on the semi-spherical surface ($0° \leqq \theta \leqq 90°$) corresponding to the second ground plane 34 will increase. When the strength of the radiation electric field of the antenna increases, the output power of the transmitting end of the radio frequency circuit can be reduced, and the sensitivity of the receiving end will be increased. And the angles for the antenna capable of receiving and transmitting can be increased. Besides, the inventive radiation device 30 has a simple structure and a low manufacture cost, and is greatly suitable to be used in the wireless communication product.

Figure 4A:
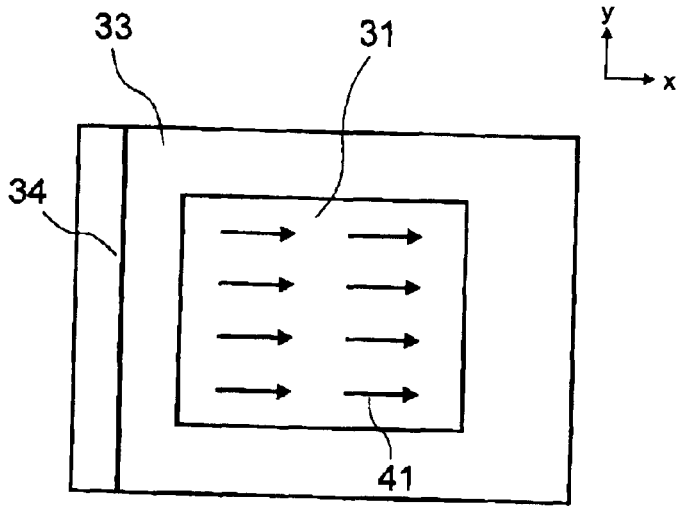
FIG. 4(*a*) is a perspective diagram of the radiation exciting current of the radiation device on the radiation patch according to the first embodiment.
Figure 4B:
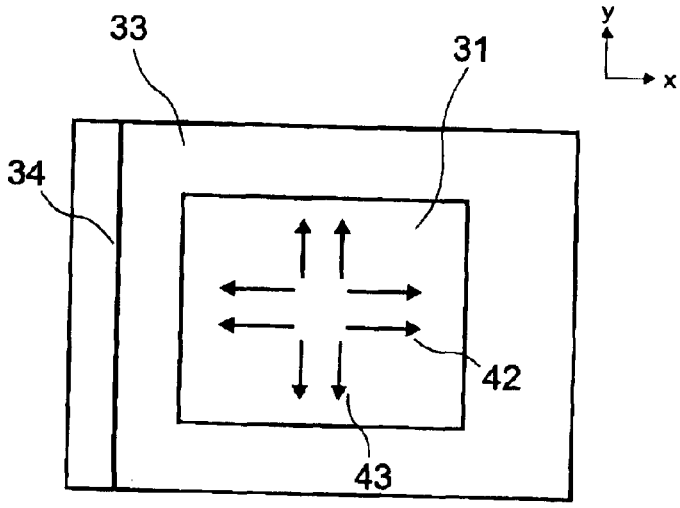

Please refer to FIGS. 4(*a*) and 4(*b*). They are the perspective diagrams of the radiation exciting current of the radiation device 30 on the radiation patch 31. FIG. 4(*a*) is a perspective diagram of the radiation exciting current in the signal polarization direction. FIG. 4(*b*) is a perspective of the radiation exciting current in the dual polarization direction. The second ground plane 34 is connected to the first ground plane 33 in the exciting current direction 41 of the radiation patch. In FIG. 4(*b*), the exciting current of the radiation patch has two directions 42, 43 perpendicular to each other, and the second ground plane 34 can be connected to the first ground plane 33 in the radiation exciting current direction 42 or 43 so as to increase the strength of the radiation electric field of the antenna.

Figure 5:
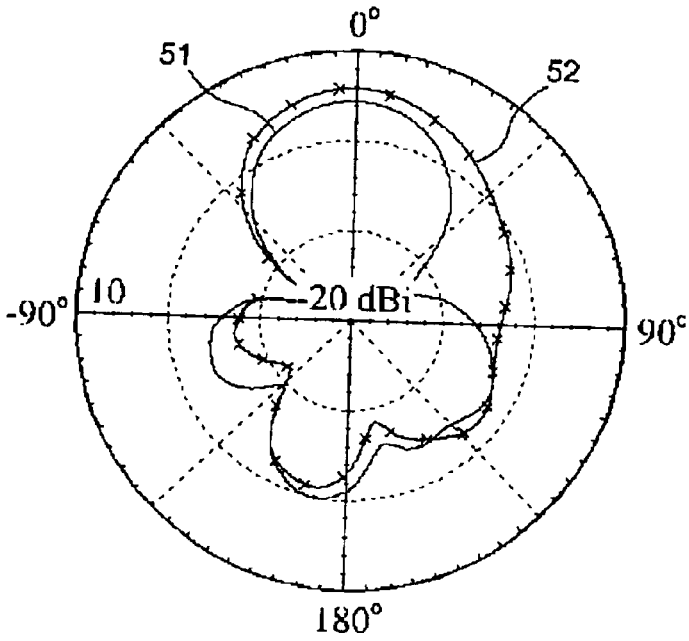
FIG. 5 shows the measured result of the antenna radiation pattern of the radiation device on the x-z plane according to the first embodiment.

Please refer to FIG. 5. FIG. 5 shows the measured result of antenna radiation pattern of the radiation device 30 on the x-z plane. The length of the radiation patch 31 is about 29 mm, and the width is about 6 mm. The distance between the radiation patch 31 and the first ground plane 33 is 6 mm, and both of the length and width of the first ground plane 33 are 40 mm. The second ground plane 34 is a ground metal sheet_perpendicularly extended upward from the left side (−x direction) of the first ground plane by 6 mm.

In FIG. 5, the reference number 51 represents the antenna radiation pattern on the x-z plane when the radiation device 30 does not have the second ground plane 34. The reference number 52 represents the antenna radiation pattern on the x-z plane when the radiation device 30 has the second ground plane 34. Based on the measured result of the radiation pattern, it is known that, compared to the radiation device 30 having no second ground plane 34, the strength of the radiation electric field on the semi-spherical surface ($0° \leqq \theta \leqq 90°$) of radiation device 30 having the second ground plane 34 in the +x direction increase apparently.

Figure 6:
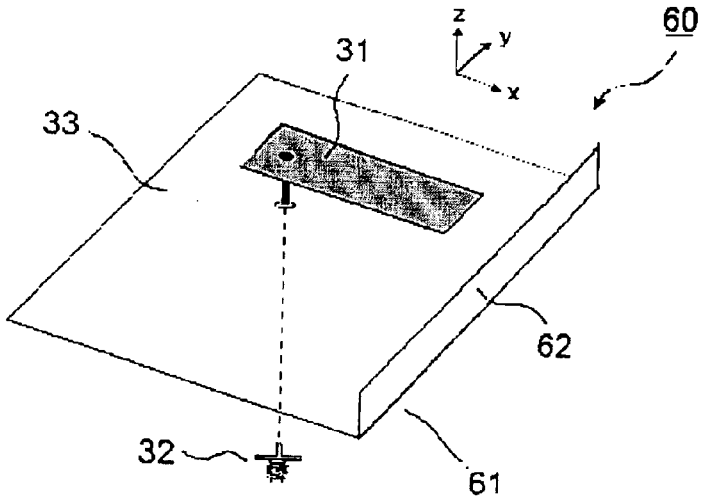
FIG. 6 is a perspective diagram of a radiation device according to a second embodiment of the present invention.

Please refer to FIG. 6. FIG. 6 is a perspective diagram of a radiation device 60 according to a second embodiment of the present invention. The difference between the radiation device 60 and the radiation device 30 is that the radiation device 60 has a different L-shaped ground plane 61. In the radiation device 60, the second ground plane 61 is installed on the right side (+x direction) of the first ground plane 33 and is extended upward by the height of 6 mm from the surface of the first ground plane 33 where the radiation patch is installed.

Figure 7:
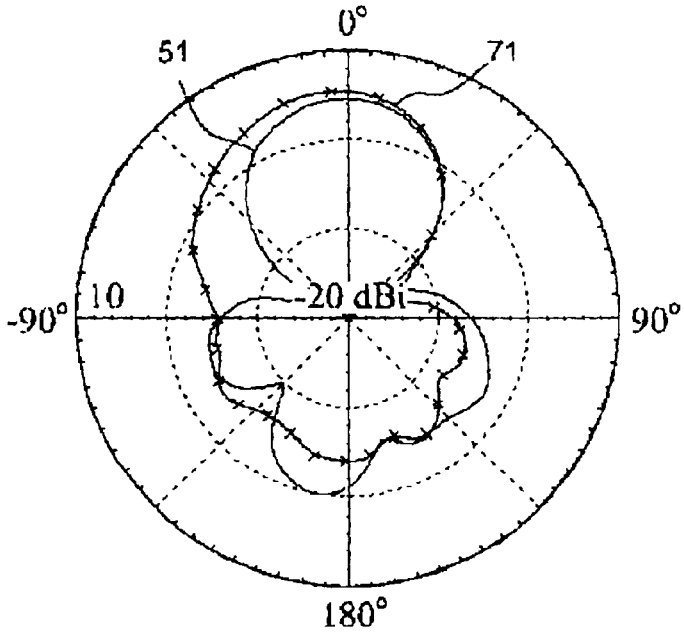
FIG. 7 shows the measured result of the antenna radiation pattern of the radiation device on the x-z plane according to the second embodiment.

Please refer to FIG. 7. FIG. 7 shows the measured result of the of the antenna pattern of the radiation device 60 on the x-z plane. The reference number 71 represents the radiation pattern of the radiation device 60, and the reference number 51 represents the radiation pattern when the radiation device 60 does not comprises the second ground plane. According to the measured result of the pattern, it can be known that compared to the radiation device 60 having no second ground plane 61, the strength of the radiation electric field on the semi-spherical surface ($0° \geqq \theta \geqq -90°$) of the radiation device 60 having the second ground plane 61 in the −x direction is increased apparently.

Based on the measured results in FIG. 5 and FIG. 7, it can be known that the strength of the radiation electric field on the semi-spherical surface of the radiation pattern corresponding to the second ground plane will increase when a second ground plane is extended upward in any side of the exciting current direction from the surface of the first ground plane 33 where the radiation patch 31 is installed. In other words, when a second ground plane is extended upward in the −x direction, as shown in the first embodiment, the strength of the radiation electric field in the +x direction will increase. In the contrary, when a second ground plane is extended upward in the +x direction, as shown in the second embodiment, the strength of the radiation electric field in the −x direction will increase.

Figure 8:
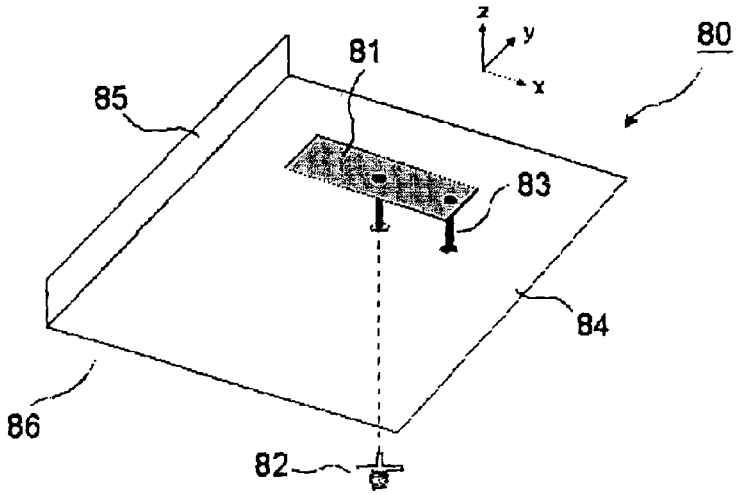
FIG. 8 is a perspective diagram of a short radiation device with a L-shaped ground plane according to a third embodiment of the present invention.

Please refer to FIG. 8. FIG. 8 is a perspective diagram of a shorted radiation device 80 with a L-shaped ground plane 86 according to a third embodiment of the present invention. The radiation device 80 comprises a radiation patch 81, a feeding-in device 82, a shorted structure 83, and a L-shaped ground plane 86. The L-shaped ground plane 86 is composed of a first ground plane 84 and a second ground plane 85. The shorted structure 83 is used for connecting the radiation patch 81 to the first ground plane 84, and the feeding-in device 82 is used for exciting the radiation patch 81 to generate the radiation. Besides, on the left side (−x direction) of the first ground plane 84, the second ground plane 85 is extended upward from the surface of the first ground plane 84 where the radiation patch 81 is installed so as to form the L-shaped ground plane 86.

The length of the radiation patch 81 is about 13 mm, and the width is about 2.5 mm. The distance between the radiation patch 81 and the first ground plane 84 is 5 mm, and the length and width of the first ground plane 84 are both 40 mm. The second ground plane 85 is a ground metal sheet extended upward by 5 mm on the left side (−x direction) of the first ground plane 84.

Figure 9:
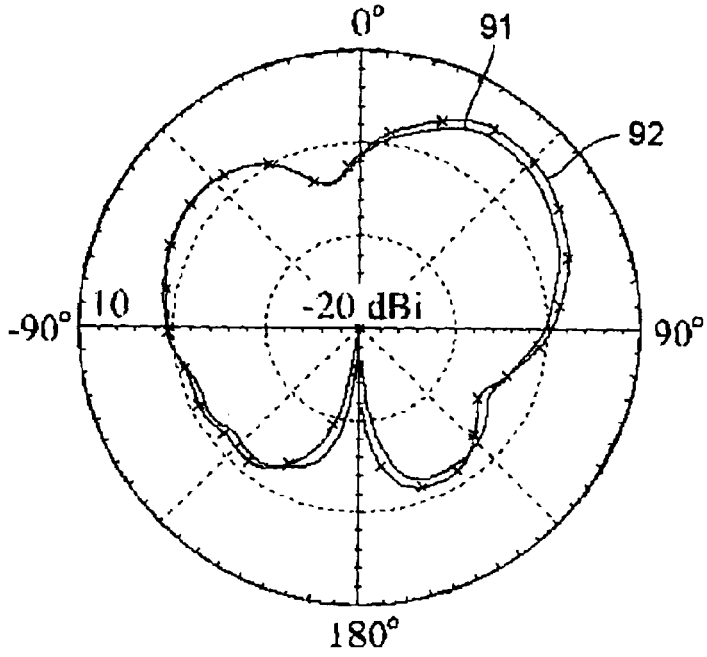
FIG. 9 shows the measured result of the antenna radiation pattern of the radiation device on the x-z plane according to the third embodiment.

Please refer to FIG. 9. FIG. 9 shows the measured result of the antenna radiation pattern of the radiation device 80 on the x-z plane. The reference number 91 represents the antenna radiation pattern of the radiation device 80 on the x-z plane when it does not have the second ground plane. The reference number 92 represents the antenna radiation pattern of the radiation device 80 on the x-z plane when it has the second ground plane. Based on the measured result of the pattern, it can be known that compared to the radiation device 80 having no second ground plane, the strength of the radiation electric field on the semi-spherical surface ($0° \leqq \theta \leqq 90°$) of the radiation device 80 having the second ground plane in the +x direction will increase.

Figure 10:
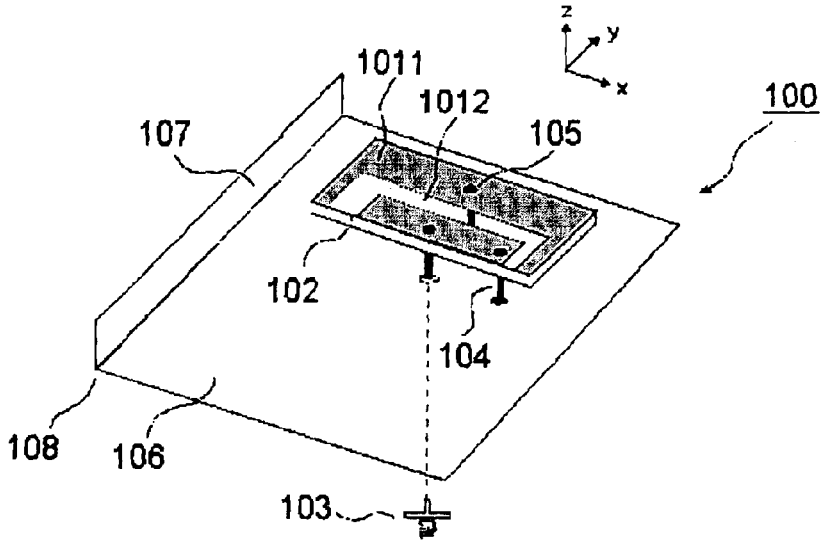
FIG. 10 is a perspective diagram of a dual-frequency shorted radiation device with a L-shaped ground plane according to a fourth embodiment of the present invention.

Please refer to FIG. 10. FIG. 10 is a perspective diagram of a dual-frequency radiation device 100 having a L-shaped ground plane 108 according to a fourth embodiment of the present invention. The radiation device 100 comprises a microwave substrate 102, a feeding-in device 103, two shorted posts 104, 105, and a L-shaped ground plane 108. The L-shaped ground plane 108 is composed of a first ground plane 106 and a second ground plane 107. As shown in the figure, the radiation patch 1011 having a greater area and the radiation patch 1012 having a smaller area are etched on the microwave substrate 102.

In addition, the feeding-in device 103 is used for exciting the smaller radiation patch 1012, and exciting the greater radiation patch 1011 by a coupling mode. Therefore, the feeding-in device 103 can simultaneously excite off the ISM (Industrial Scientific Medical) bands of 2.4 GHz and 5.2 GHz. Furthermore, the two radiation patch 1011 and 1012 are connected to the first ground plane 106 via the shorted posts 104, 105, and on the left side (−x direction) of the first ground plane 106, the second ground plane 107 is extended upward from the surface of the first ground plane 106 where the microwave substrate 102 is installed. The ground plane structure composed of the first ground plane 106 and the second ground plane 107 is the L-shaped ground plane 108.

The length of the greater radiation patch 1011 is about 19 mm, and the width is about 10 mm. The length of the smaller radiation patch 1012 is about 12 mm, and the width is about 2.5 mm. The distance between the greater radiation patch 1011 and the first ground plane 106 is 5 mm and the same as the distance between the smaller radiation patch 1012 and the first ground plane 106. Both of the length and width of the first ground plane 106 are 40 mm. And the second ground plane 107 is a ground metal sheet extended upward by 5 mm on the left side (−x direction) of the first ground plane 106.

Please refer to FIG. 11. FIG. 11 shows the measured result of the antenna radiation pattern of the radiation device 100 on the x-z plane when the radiation device 100 is operated in a high frequency according to the fourth embodiment. The reference number 111 represents the antenna radiation pattern on the x-z plane when the radiation device 100 does not have the second ground plane. The reference number 112 represents the antenna radiation pattern on the x-z plane when the radiation device 100 has the second ground plane. Based on the measured result of the radiation pattern, compared to the radiation device 100 having no second ground plane, the strength of the radiation electric field on the semi-spherical surface ($0° \leqq \theta \leqq 90°$) of the radiation device 100 having the second ground plane in the +x direction will apparently increase.

Please refer to FIG. 12. FIG. 12 is a perspective diagram of a radiation device according to a fifth embodiment of the present invention. The radiation device 120 comprises a radiation patch 121, a feeding-in device 122, and a L-shaped ground plane 125. The L-shaped ground plane 125 is composed of a first ground plane 123 and a second ground plane 124. Compared with the other embodiments, the characteristic of the radiation device 120 is that the radiation patch 121 is a circular patch.

Compared with the prior art, the radiation device according to the present invention has the L-shaped ground plane, and therefore, the strength of the antenna radiation electric field on the semi-spherical surface ($|\theta| \leqq 90°$) corresponding to the second ground plane will increase so as to promote the gain of the antenna on the semi-spherical surface of $|\theta| \leqq 90°$. Thus, the power output of the transmitting end of the radio frequency circuit will be reduced, and the sensitivity of the receiving end will be increased. In addition, the angles for the antenna capable of receiving and transmitting can be increased, and the inventive radiation device has a low manufacture cost, and is greatly suitable to be used in the wireless communication product.

Furthermore, the radiation device according to the present invention has a simple structure and the height of the antenna will not be affected. Besides, the radiation gain of the antenna radiation pattern in the direction of $|\theta| \leqq 90°$ can be promoted. Therefore, the inventive radiation device is greatly suitable to be used in all kinds of the planar patch antenna structures, such as the shorted patch antennas, the dual-frequency patch antennas and so on.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A radiation device with an L-shaped ground plane comprising:

a radiation patch;

a feeding-in device for exciting the radiation patch; and a single ground plane element consisting of a first ground plane and a second ground plane, the first ground plane being parallel to the radiation patch, and the second ground plane being installed on the first ground plane so as to form an included angle between the first and second ground planes;

wherein the feeding-in device connects the radiation patch to the first ground plane of the ground plane element, said radiation patch being spaced-from and not in contact with said second ground plane.

2. The radiation device of claim 1, wherein the included angle between the first ground plane and the second ground plane is less than or equal to 90 degrees.

3. The radiation device of claim 1, wherein the included angle between the first ground plane and the second ground plane is greater than or equal to 90 degrees.

4. The radiation device of claim 2, wherein the ground plane element is an L-shaped ground plane.

5. The radiation device of claim 1, wherein on the left side of the first ground plane, the second ground plane is extended upward from the surface of the first ground plane where the radiation patch is installed so as to form the ground plane element.

6. The radiation device of claim 1, wherein on the right side of the first ground plane, the second ground plane is extended upward from the surface of the first ground plane where the radiation patch is installed so as to form the ground plane element.

7. The radiation device of claim 1, wherein the height of the second ground plane is not greater than twice a distance between the radiation patch and the first ground plane.

8. The radiation device of claim 1, wherein the radiation patch is rectangular.

9. The radiation device of claim 1, wherein the radiation patch is circular.

10. The radiation device of claim 1 further comprising a shorted structure installed between the radiation patch and the first ground plane.

* * * * *